United States Patent [19]

Portyansky

[11] Patent Number: 4,567,997

[45] Date of Patent: Feb. 4, 1986

[54] STICK DELIVERY MECHANISM

[75] Inventor: Alexander Portyansky, Philadelphia, Pa.

[73] Assignee: North Eastern Timber (USA) Inc., Camden, N.J.

[21] Appl. No.: 465,950

[22] Filed: Feb. 14, 1983

[51] Int. Cl.[4] ..... G07F 11/24

[52] U.S. Cl. ..... 221/233; 221/236; 221/263; 227/118; 425/9; 425/126 S

[58] Field of Search ..... 221/233–234, 221/236, 237, 263, 291, 290; 198/409; 227/100, 117, 118; 425/9, 126 S

[56] References Cited

U.S. PATENT DOCUMENTS

| | | | |
|---|---|---|---|
| 853,194 | 5/1907 | Vandiver | 221/237 X |
| 1,695,460 | 12/1928 | Iwanicki . | |
| 2,914,162 | 11/1959 | Anger | 198/409 |
| 2,969,892 | 1/1961 | Sherman | 221/210 |
| 3,321,106 | 5/1967 | Shields | 221/210 |
| 3,409,170 | 11/1968 | Orcutt | 221/237 X |
| 3,737,072 | 6/1973 | Deitrick | 221/266 |
| 4,293,292 | 10/1981 | Israel | 425/9 |

FOREIGN PATENT DOCUMENTS

| | | | |
|---|---|---|---|
| 127129 | 5/1899 | Fed. Rep. of Germany . | |
| 869811 | 6/1961 | United Kingdom | 221/233 |

*Primary Examiner*—Charles A. Marmor

*Attorney, Agent, or Firm*—Seidel, Gonda, Goldhammer & Abbott

[57] ABSTRACT

Stick delivery mechanism especially for but not limited to use in a candy floss machine for delivering a stick from a storage facility to a feed position from which the stick can enter a device which rotates the stick about its own axis.

10 Claims, 15 Drawing Figures

FIG. 6A
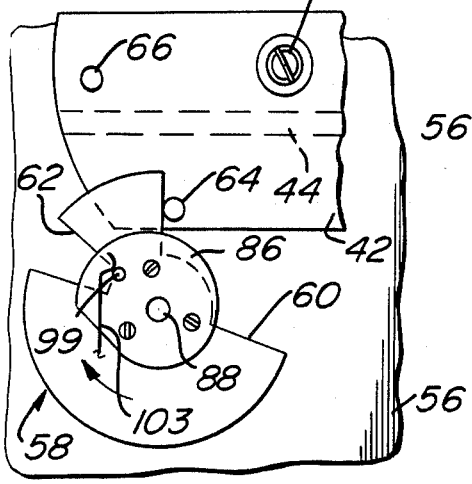
FIG. 6B
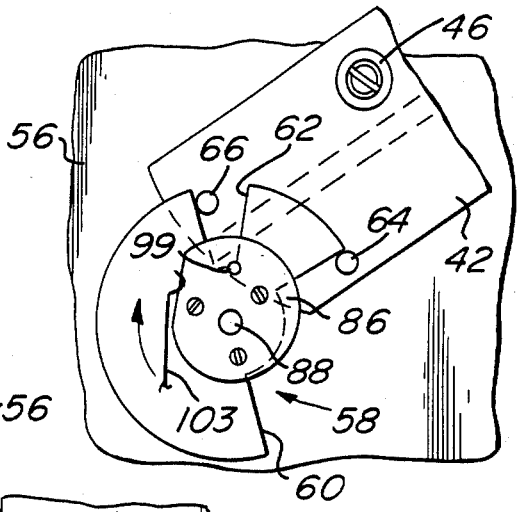
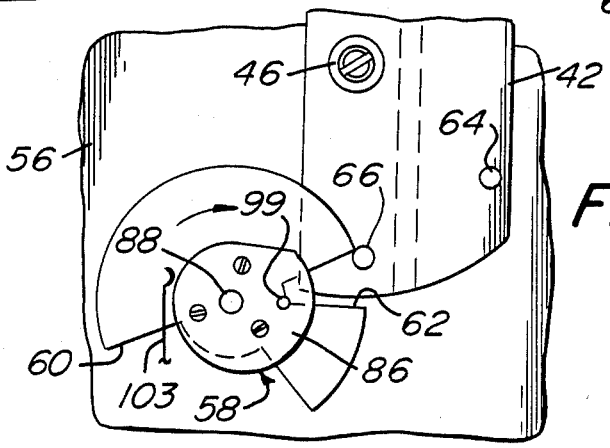
FIG. 6C
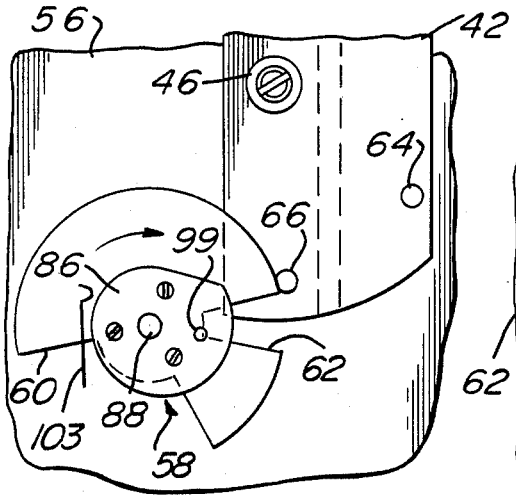
FIG. 6D
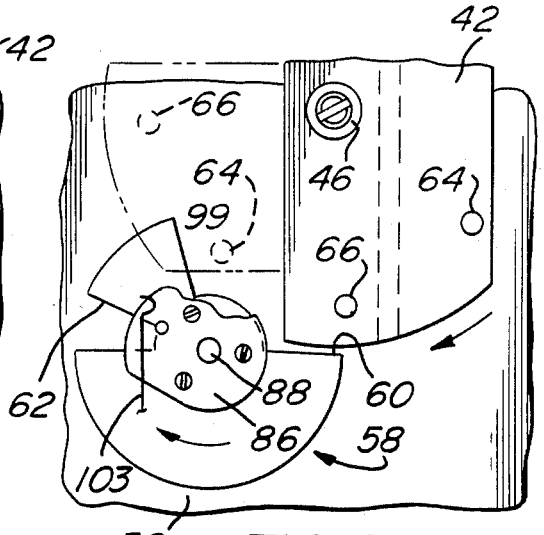
FIG. 6E

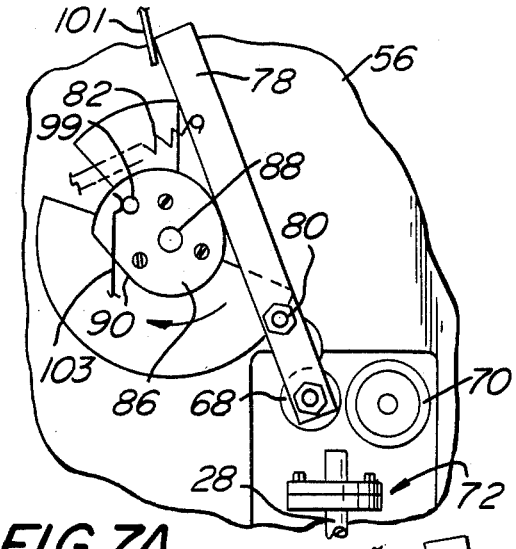
FIG. 7A
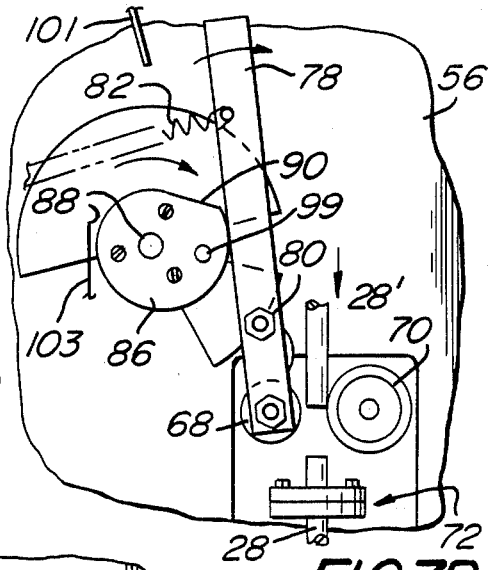
FIG. 7B
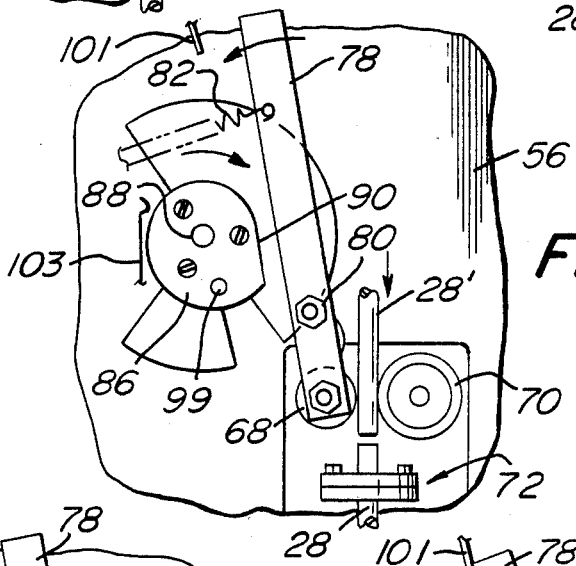
FIG. 7C
FIG. 7D
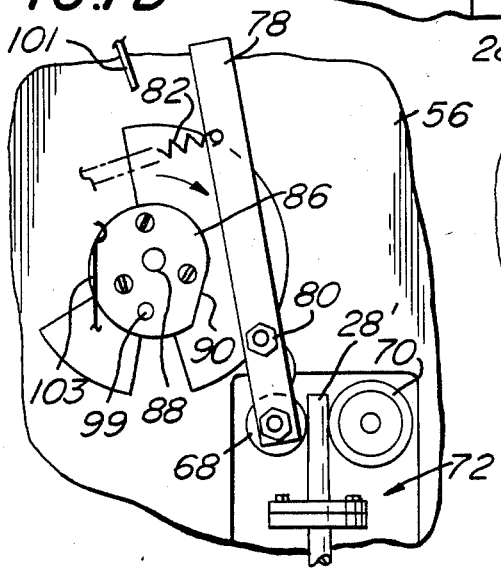
FIG. 7E
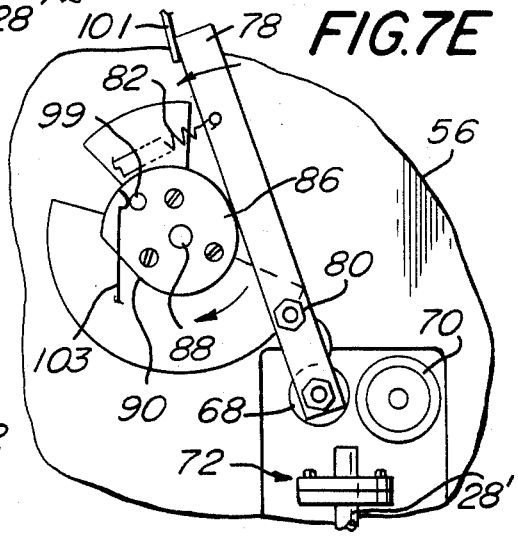

STICK DELIVERY MECHANISM

BACKGROUND OF THE INVENTION

The present invention is directed to a stick delivery mechanism especially for but not limited to use in a candy floss machine. Candy floss machines having automatic stick delivery mechanisms are known. For example, see U.S. Pat. No. 4,293,292 (Israel) issued Oct. 6, 1981 and French Pat. No. 2,248,792 (General Properties Anstalt) issued Oct. 10, 1976. Stick delivery mechanisms of the type disclosed in the patents are not entirely satisfactory in that the sticks are often misaligned, jammed and chipped or deformed during delivery.

A stick delivery mechanism of the type wherein sticks are inserted in food products is disclosed in U.S. Pat. No. 4,232,811 (Cottrell) issued Nov. 11, 1980. In this patent, a stick is swung from a lateral position to a vertical position, and the stick is held by a pedestal in the vertical position as a food product is impressed on the stick.

There is a present need in the candy floss machine field for a stick delivery mechanism which automatically delivers a stick from a storage facility to a feed position from which the stick can be advanced to a device which rotates the stick about its own axis as candy floss is collected on the stick.

An advantage of the stick delivery mechanism of the present invention is that sticks are delivered automatically one at a time to a feed position from which they can be advanced to a device for spinning the stick about its own axis as floss is collected on the stick.

Another advantage of the invention is that the mechanism for delivering the stick is extremely reliable and of relatively simple construction.

Other objects and advantages will appear hereinafter.

SUMMARY OF THE INVENTION

A stick delivery mechanism for delivering a stick to a feed position from which the stick can enter a device which rotates the stick about its own axis comprises a stick storage and dispensing means for storing sticks and for dispensing the sticks one at a time to a rest position; a stick rotating means for holding and rotating a stick about an axis transverse to the axis of the stick from the rest position to a feed position; said stick rotating means including means for slidably releasing a stick under gravity at the feed position.

FIGS. 6A–E comprise a diagram of the cam motion.

FIGS. 7A–E comprise a diagram of the eccentric motion.

DETAILED DESCRIPTION OF THE INVENTION

Figure 1:
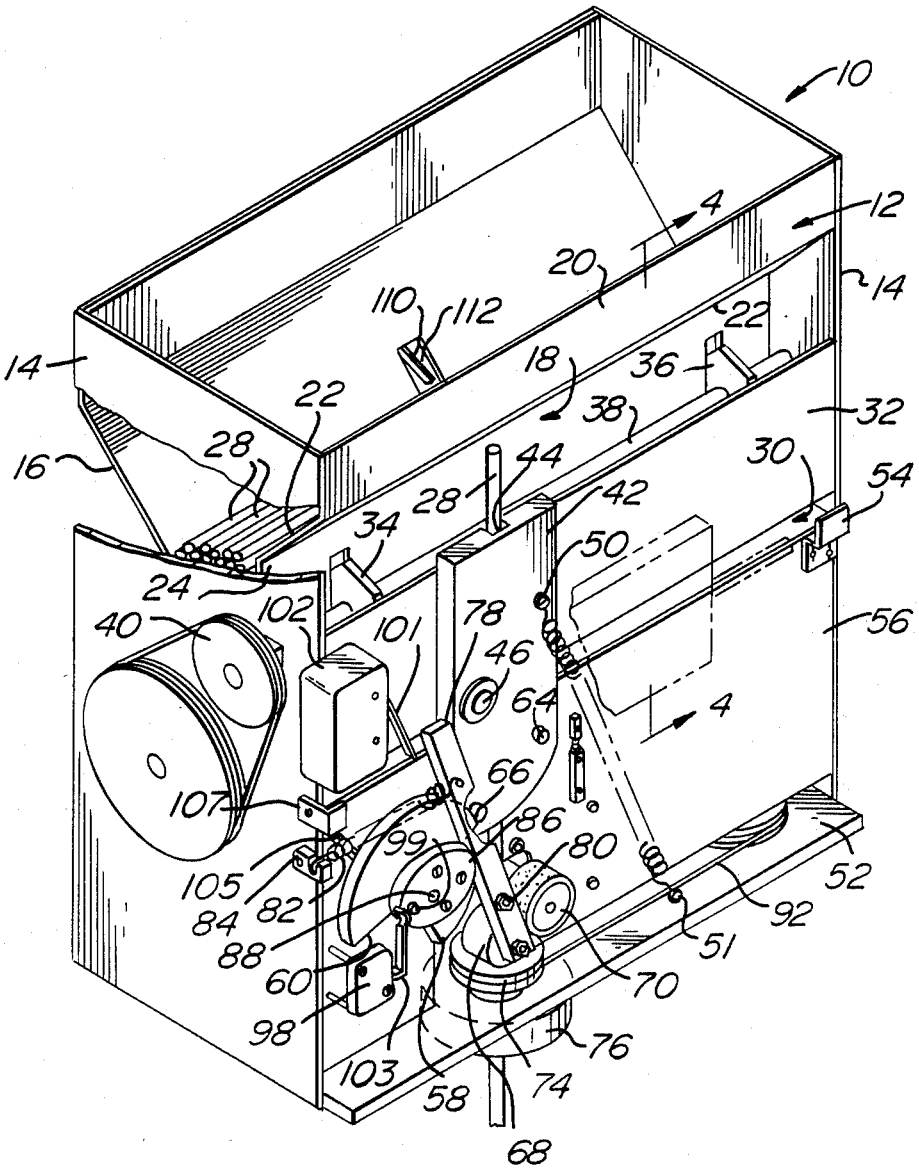
FIG. 1 is a perspective view of the stick delivery mechanism of the present invention.
Figure 4:
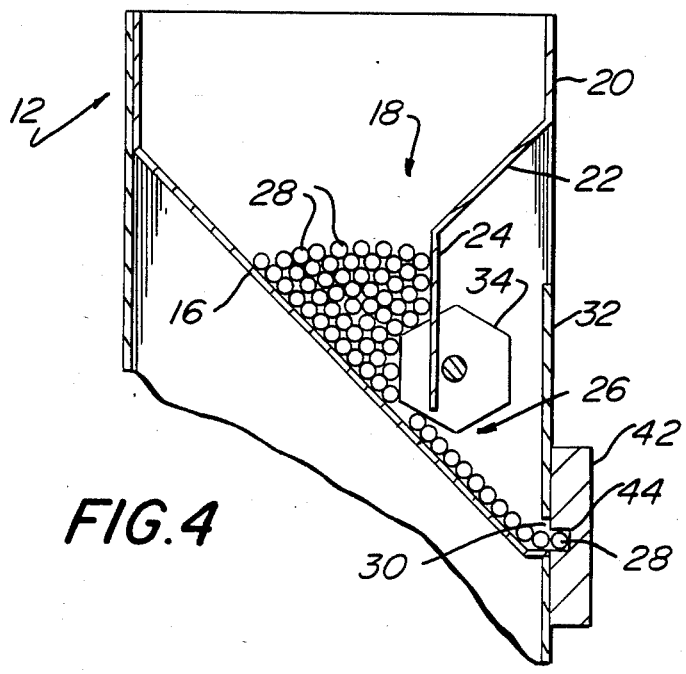
FIG. 4 is a simplified cross-section taken along 4—4 in FIG. 1.

Referring to the drawings wherein like numerals indicate like elements there is shown in FIG. 1 a stick delivery mechanism according to the present invention designated generally as 10. The stick delivery mechanism 10 includes a hopper 12 bounded by the sidewalls of a frame 14. The hopper is provided with a canted rear wall 16 and a front wall 18 having a substantially upright portion 20, inwardly canted portion 22 and substantially upright portion 24. The upright portion 24 terminates proximate the rear wall 16 so as to define a throat 26 for the passage of rolled paper sticks 28. The sticks are fed under gravity from the hopper 12 in single file on the rear wall 16 to a slot 30 between wall 16 and a front plate 32 secured at each end to the frame 14. See FIG. 4.

Figure 5:
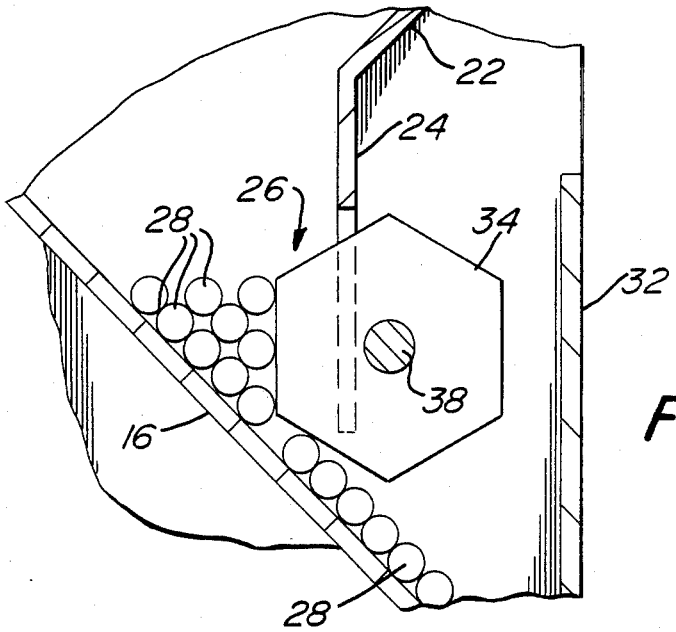
FIG. 5 is an enlarged partial section taken in FIG. 4.

Proximate the throat 26, there are located two multiple-sided (for example, hexagonal) rotary elements 34, 36 mounted on a support shaft 38 journalled at one end in a bearing mounted on frame 14 and connected at its other end to a driven pulley 40 mounted on the frame. See FIGS. 1 and 5. The shaft 38 rotates the elements 34, 36, causing the elements to agitate the sticks 28 within hopper 12 so as to facilitate feeding of the sticks through throat 26 without jamming.

An elongated rotary plate 42 provided with a groove 44 along its entire length is pivotably mounted on the front plate 32 by a pin 46 which is journalled in the front plate 32 and secured to the rotary plate 42. See FIG. 1. The plate 42 is normally maintained in the horizontal position with groove 44 in juxtaposition with slot 30 by means of a spring 48 secured at one end to plate 42 by a screw 50, and secured at its other end to the frame bottom wall 52 by a screw 51.

A stick 28 is fed along the hopper rear wall 16 by gravity through slot 30 into the groove 28 in plate 42 when the plate is aligned with slot 30. The stick 28 and plate 42 may be said to be in a "rest" position at this time, an extremity of the stick being supported by a flanged support element 54 secured to a lower front plate 56 coupled to the sidewalls of frame 14.

A motor-driven circular cam 58 having a pair of circumferentially spaced cut-outs or notches 60, 62 is rotated clock-wise (CW) so as to pivot the plate 42 counter clock-wise (CCW) about the axis of pin 46 and bring plate 42 and a stick 28 (in groove 40) to a "feed" position. Plate 42 is provided with a pair of spaced follower pins 64, 66 which cooperate with the notches 60, 62 in cam 58 as described hereafter to swing plate 42 between the lateral or "rest" position and the vertical or "feed" position.

Figure 2:
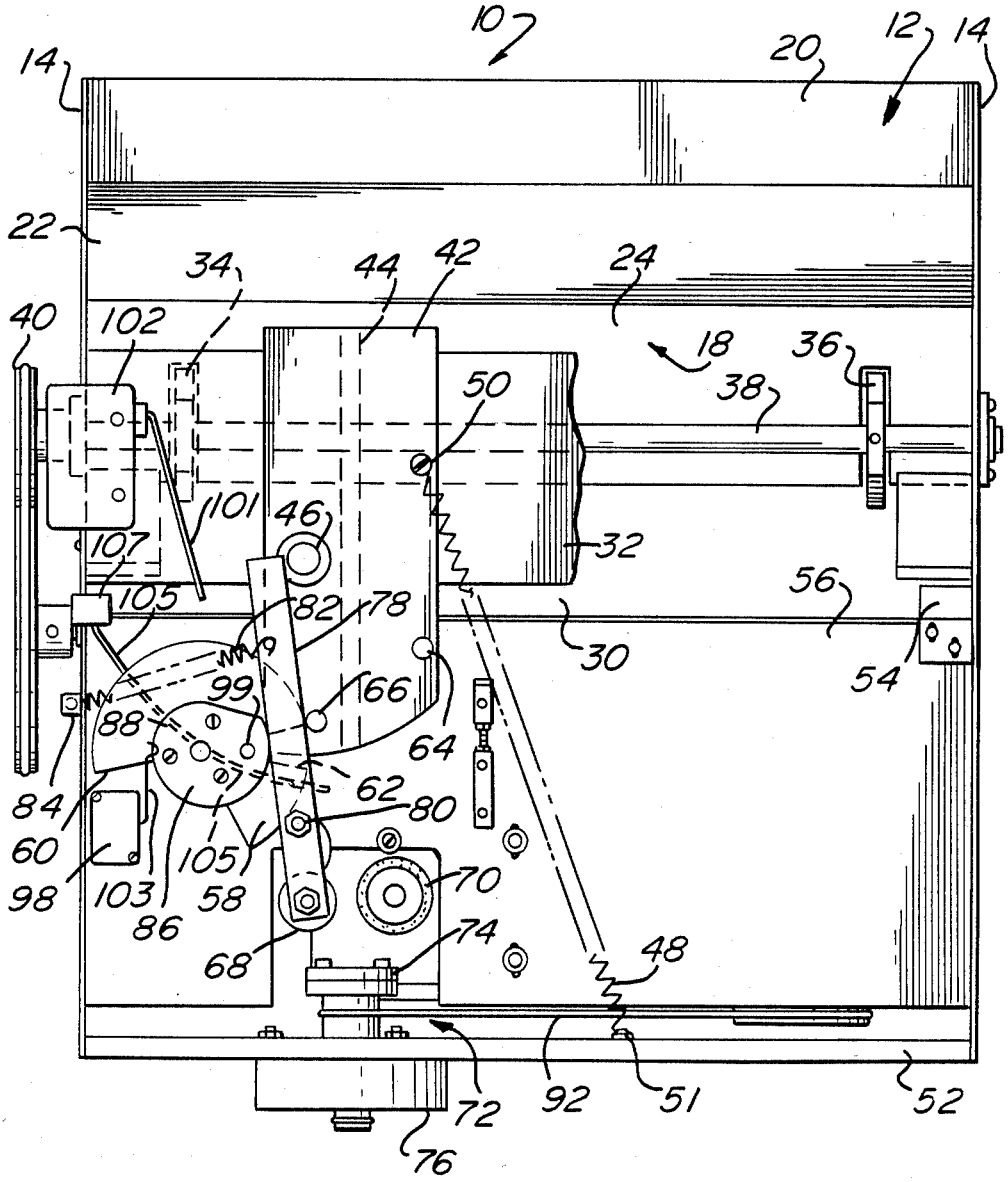
FIG. 2 is a front elevation of the stick delivery mechanism as shown in FIG. 1.

Referring to FIGS. 6A–E, the motion of cam 58 and plate 42 is shown diagramatically. Although, not shown in FIGS. 6A–E, it should be understood that a stick 28 is seated in the groove 44 of plate 42 as the plate is rotated from the "rest" position. The stick is prevented from dropping by gravity out of the groove, until the plate reaches the "feed" position, by a curved guide 105 secured to a bracket 107 mounted on frame 14. See FIGS. 1 and 2.

Initially, plate 42 is in the lateral or "rest" position with pins 64, 66 disposed as shown in FIG. 6A. In the "rest" position, pin 64 is spaced from the left flank of notch 60. As cam 58 rotates CW, the left flank of notch 60 contacts pin 64 and urges plate 42 CCW with respect to the axis of pin 46. Both pins 64, 66 are rotated CCW as the cam continues to rotate CW, and pin 66 moves into engagement with notch 62 as pin 64 escapes from notch 60 as shown in FIG. 6B. The left flank of notch 62 moves pin 66 CCW with respect to the axis of pin 46 until pin 66 escapes from the notch as shown in FIG. 6C. This corresponds to the "feed" position of plate 42. As pin 66 escapes from notch 62, the plate 42 tends to rotate CW back to the "rest" position under return force of the spring 48. Return motion of the plate 42 to the "rest" position, however, is prevented by the peripheral surface of cam 58 which blocks movement of the pin 66 in the CW direction as shown in FIG. 6D. The cam 58 continues to rotate until the right flank of notch 60 moves into alignment with pin 66 as shown in FIG. 6E. At this point, the pin is freed and the plate 42 pivots CW about the axis of pin 46 under the return force of spring 48 so as to bring the plate back to the "rest" position with pins 64, 66 again positioned as shown in FIG. 6A.

In the "feed" position of plate 42, stick 28 slides downwardly in groove 44 under gravity towards a pair of rollers comprising an idler roller 68 having a smooth outer metallic surface and a motor driven roller 70 having a high friction outer surface such as rubber. Rollers 68, 70 are positioned at an elevation between plate 42 and a device 72 for rotating or spinning the stick about its own axis. The device 72 is of conventional construction comprising a belt driven split collet 74 and a sleeve 76. The structure and operation of device 72 is described in detail in U.S. Pat. No. 4,293,292 (Israel) issued Oct. 6, 1981 incorporated herein by reference.

The idler roller 68 is rotatably mounted on a lever arm 78 which is pivotably mounted on the lower front plate 56 by a pin 80. The pin 80 is journalled in plate 56 and secured by a nut to the lever arm 78. The lever arm is spring urged CCW about the axis of pin 80 by a spring 82 secured at one end to the lever arm and at the other end to an anchor block 84 mounted on a sidewall of frame 14.

The lever arm 78 contacts the peripheral surface of an eccentric 86 which is rotatably mounted on the same motor driven shaft 88 as is cam 58. The eccentric 86 rotates in unison with cam 58 to pivot the lever arm 78 about the axis of pin 80 in timed relation with the rotation of plate 42 as shown diagramatically in FIGS. 7A–E. The eccentric 86 has a reduced diameter portion, an increased diameter portion, and a flat 90 connecting the two.

At the start of a machine cycle, a stick 28 previously secured in the device 72 is spun about its own axis to collect floss produced by a head (not shown) as described in U.S. Pat. No. 4,293,292. The increased diameter portion of eccentric 86 contacts lever arm 78 as the eccentric rotates CW thereby pivoting the lever arm CW about the axis of pin 80 to produce a clearance between rollers 68, 70 as shown in FIGS. 7A and B. The plate 42 is rotated to the feed position at approximately this time so that a stick 28' is slidably released from the plate under gravity towards the rollers 68, 70. As the eccentric 86 continues to rotate CW on shaft 88, the increased diameter portion of the eccentric clears lever arm 78 and the lever arm moves CCW under the return force of spring 82. Roller 68 moves towards roller 70, and the rollers grip the stick 28' securely. Roller 70 is then motor driven so as to advance the stick 28' downwardly into contact with the top of the stick 28 which is still held by device 72 as shown in FIG. 7C. As the rollers drive stick 28' downwardly, stick 28' displaces stick 28 from device 72 as shown in FIG. 7D. During this time, the eccentric 86 continues to rotate CW on shaft 88. When stick 28' clears rollers 68, 70, the spring 82 pulls the lever arm into contact with the reduced diameter portion of the eccentric thereby pivoting the lever arm CCW about the axis of pin 80 so that the clearance between rollers 68, 70 is reduced as shown in FIG. 7E. At the beginning of the next machine cycle, stick 28' is spun about its own axis by device 72, and floss is collected on the stick. The stick is then ejected by a fresh stick released by plate 42 and advanced downwardly towards device 72 as previously described. The ejected stick falls by gravity into a basket or other collection device (not shown).

Motor operation of the cam 58 and eccentric 86, roller 70 and device 72, as well as the shaft 38, is sequenced by a series of limit switches 98, 102, 110 arranged as shown in FIG. 1. A machine cycle is initiated in conventional manner by a coin box mechanism (not shown). At the beginning of the machine cycle, the collet 74 is rotated by a belt 92 driven by a motor 94 secured to the frame bottom wall 52. See FIG. 3. The motor 94 is operated for a suitable length of time to permit the desired amount of floss to collect on the stick. Thereafter, a motor 96 mounted on the rear of wall 56 is energized, and the motor rotates shaft 88 so as to rotate cam 58 CW and swing plate 42 CCW to the "feed" position. A fresh stick then drops by gravity towards rollers 68, 70. As motor 96 drives shaft 88, the eccentric 86 pivots lever arm 78 CW to create a clearance between rollers 68, 70 so as to accept the released stick. As the lever arm 78 pivots CW, it releases a switch blade 101 which is part of a microswitch 102. When released, the switch energizes a motor 100 mounted on the frame sidewall which rotates the shaft (not numbered) on which roller 70 is mounted. The roller 70 in cooperation with roller 68 drives the released stick downwardly towards device 72. The motor 100 continues to rotate roller 70 so as to drive the stick into collet 74 while the stick already in collet 74 is ejected into a basket or other collection device. As the driven stick clears rollers 68, 70, the lever arm 78 contacts the reduced diameter portion of eccentric 88 as shown in FIG. 7D so as to reduce the clearance between rollers 68, 70. The lever arm contacts switch blade 101 thereby cutting off roller drive motor 100. The plate 42 is snapped back to the "rest" position where it accepts another stick from the hopper. After one complete revolution of the cam, the cam and plate 42 are back at the positions shown in FIG. 6A, and a pin 99 on eccentric 86 contacts a switch blade 103 which is part of a microswitch 98. When blade 103 is contacted, microswitch 98 cuts off the cam motor 96, so that the cam and eccentric are reset to their original starting positions.

At the end of each cycle, i.e. after one cam revolution, a new stick is dispensed by gravity to slot 30 and enters groove 40 in plate 42. During each machine cycle, the multiple-sided elements 34 are rotated by shaft 38. The shaft 38 is rotated by a motor 104 mounted on the frame side wall (FIG. 3) via a belt and pulley arrangement when motor 96 is operated.

Figure 3:
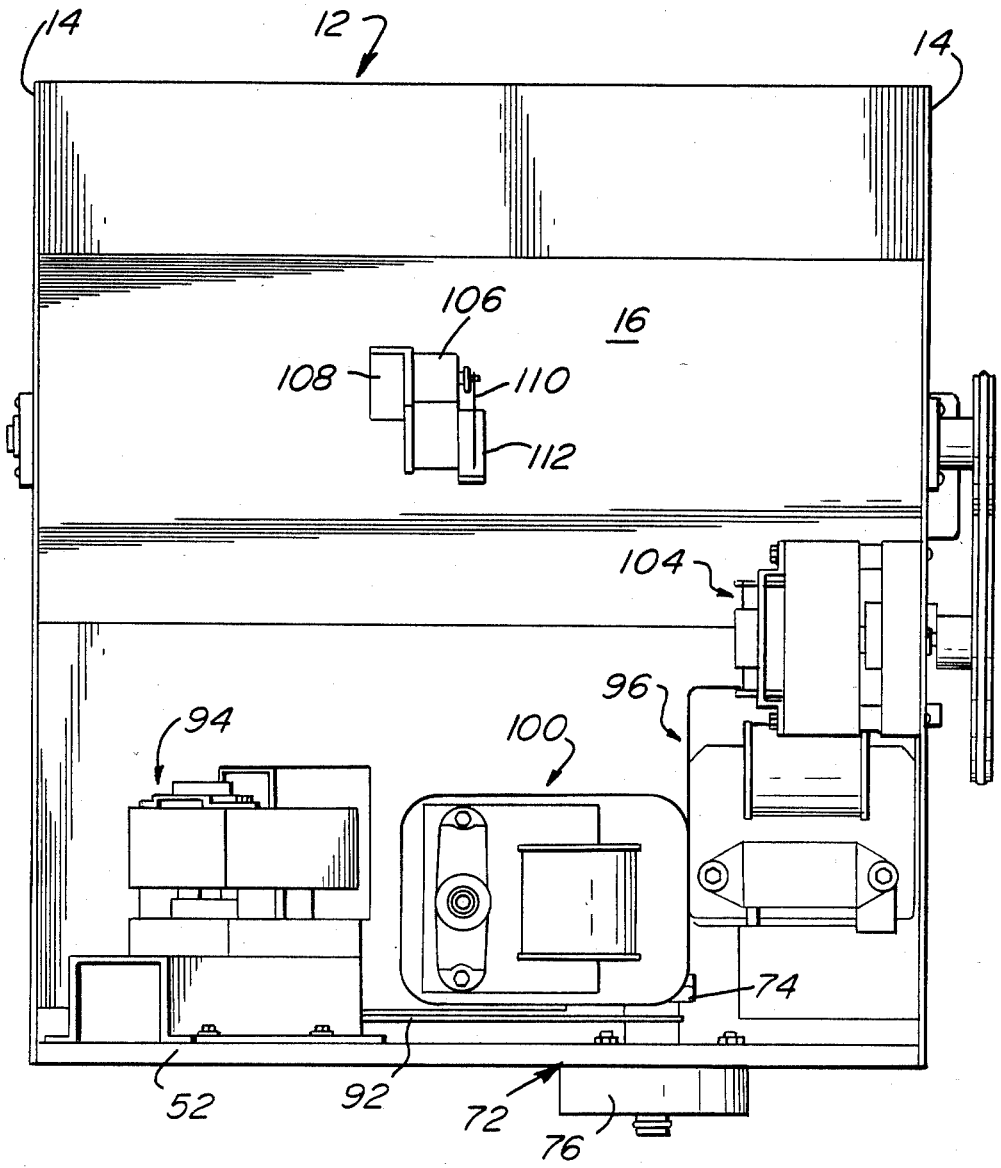
FIG. 3 is a rear view of the mechanism.

As shown in FIG. 3, a microswitch 106 is mounted on an angle bracket 108 secured to the back side of the canted rear wall 16 of hopper 12. The microswitch 106 is provided with a switch blade 110 oriented so as to project through an opening 112 in the rear wall 16. When the hopper is filled with sticks, the sticks contact the switch blade 110 so as to maintain the microswitch 106 open. As the level of sticks in the hopper drops during machine use, the switch blade 110 is freed thereby enclosing the microswitch 106 so as to energize an alarm such as a warning light and/or disable the machine coin mechanism until the supply of sticks is replenished in the hopper.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus comprising:
(a) stick storage and dispensing means for storing sticks and dispensing the sticks one at a time to a horizontal rest position,
(b) stick rotating means for holding and rotating a stick about an axis transverse to the axis of the stick from said rest position to a vertical feed position,
(c) said stick rotating means including means for slidably releasing said stick under gravity at the feed position,
(d) stick drive means in synchronous operative association with said stick rotating means for receiving a released stick and for driving the stick downwardly.

2. Apparatus for delivering a stick to a stick spinning device which spins the stick about its own axis, comprising:
(a) stick storage and dispensing means for storing sticks and dispensing the sticks one at a time to a horizontal rest position,
(b) stick rotating means for holding and rotating a stick about an axis transverse to the axis of the stick from a rest position to a vertical feed position,
(c) stick drive means in synchronous operative association with said stick rotating means for engaging a stick and for driving the stick so as to displace the stick towards the stick spinning device,
(d) said stick rotating means including means for slidably releasing a stick under gravity at the feed position to said stick drive means.

3. Apparatus according to claim 2 wherein said stick drive means includes means for rollably driving the stick along its axis towards the stick spinning device.

4. Apparatus according to claim 2 including a cam operatively associated with the stick rotating means for causing the stick rotating means to rotate the stick and an eccentric operatively associated with said cam and with said stick drive means for causing said stick drive means to engage and drive the stick in timed relation with said stick rotating means.

5. A stick delivery mechanism, comprising:
(a) stick storage and dispensing means for storing sticks and for delivering sticks one at a time to a horizontal rest position,
(b) a rotary element provided with a groove for receiving and holding a stick delivered to the rest position,
(c) said rotary element being rotatable so as to move the stick from the rest position to a vertical feed position,
(d) said groove being adapted to slidably release said stick under gravity when the rotary element is rotated to the feed position,
(e) stick drive means in synchronous operative association with said rotary element for engaging a stick as it is released under gravity and for rollably driving the released stick so as to displace the stick from said groove.

6. Stick delivery mechanism according to claim 5 wherein said stick drive means includes a spring-urged pivotable lever arm, roller means operatively associated with the lever arm for engaging and rollably driving the stick, and means for pivoting the lever arm so as to cause said roller means to engage and to rollably drive the stick.

7. Stick delivery mechanism according to claim 6 including means for rotating the rotary element in timed relation with said means for pivoting the lever arm.

8. A stick delivery mechanism comprising:
(a) stick storage and dispensing means for storing sticks and for dispensing sticks one at a time to a horizontal rest position,
(b) a rotary element provided with a groove for holding a stick delivered to the rest position,
(c) said rotary element being rotatable so as to move the stick from said rest position to a vertical feed position,
(d) said groove being adapted to slidably release the stick under gravity when the rotary element is rotated to the feed position,
(e) stick drive means in synchronous operative association with said rotary element for engaging a stick as it is released under gravity and for driving the released stick out of said groove.

9. Stick delivery mechanism according to claim 8 wherein said stick drive means includes a spring-urged pivotable lever arm, roller means operatively associated with the lever arm for engaging and rollably driving the stick, and means for pivoting the lever arm so as to cause said roller means to engage and rollably drive the stick.

10. Stick delivery mechanism according to claim 9 including means for rotating the rotary element in timed relation with said means for pivoting the lever arm.

* * * * *